US009468253B2

(12) United States Patent
Floriot Godin

(10) Patent No.: US 9,468,253 B2
(45) Date of Patent: Oct. 18, 2016

(54) ADJUSTABLE SHOE

(76) Inventor: Chrystel Floriot Godin, Issy les Moulineaux (FR)

( * ) Notice: Subject to any disclaimer, the term of this patent is extended or adjusted under 35 U.S.C. 154(b) by 248 days.

(21) Appl. No.: 14/232,309

(22) PCT Filed: Jul. 11, 2012

(86) PCT No.: PCT/FR2012/000284

§ 371 (c)(1),
(2), (4) Date: Jan. 13, 2014

(87) PCT Pub. No.: WO2013/007895

PCT Pub. Date: Jan. 17, 2013

(65) Prior Publication Data

US 2014/0130379 A1 May 15, 2014

(30) Foreign Application Priority Data

Jul. 13, 2011 (FR) ..... 11 56403

(51) Int. Cl.

| | |
|---|---|
| ***A43B 3/12*** | (2006.01) |
| ***A43B 3/24*** | (2006.01) |
| ***A43B 13/36*** | (2006.01) |
| ***A43B 1/00*** | (2006.01) |
| ***A43B 3/10*** | (2006.01) |
| ***A43B 9/00*** | (2006.01) |
| ***A43B 13/14*** | (2006.01) |
| ***A43B 23/24*** | (2006.01) |

(52) U.S. Cl.

CPC ..... *A43B 3/244* (2013.01); *A43B 1/0054* (2013.01); *A43B 1/0081* (2013.01); *A43B 3/103* (2013.01); *A43B 3/108* (2013.01); *A43B 3/122* (2013.01); *A43B 3/128* (2013.01); *A43B 9/00* (2013.01); *A43B 13/14* (2013.01); *A43B 13/36* (2013.01); *A43B 23/24* (2013.01)

(58) Field of Classification Search

CPC ..... A43B 1/0081; A43B 3/12; A43B 3/122; A43B 23/24; A43B 13/36

USPC ..... 36/15, 11.5, 100, 101, 136

See application file for complete search history.

(56) References Cited

U.S. PATENT DOCUMENTS

| | | | | |
|---|---|---|---|---|
| 2,343,701 A | | 3/1944 | Pickens | |
| 2,381,389 A | * | 8/1945 | Riesing | A43B 1/14 36/11.5 |
| 2,526,940 A | * | 10/1950 | Fello | A43B 3/122 36/11.5 |
| 2,595,643 A | | 5/1952 | Daugherty | |
| 2,732,065 A | * | 1/1956 | Marchese | A43C 15/02 152/208 |

(Continued)

FOREIGN PATENT DOCUMENTS

| | | |
|---|---|---|
| DE | 20 2008 015 275 | 5/2009 |
| FR | 1 005 168 | 4/1952 |

OTHER PUBLICATIONS

International Search Report dated Oct. 5, 2012, corresponding to PCT/FR2012/000284.

*Primary Examiner* — Marie Bays
(74) *Attorney, Agent, or Firm* — Young & Thompson

(57) ABSTRACT

The shoe (10) includes a sole (11), in particular having an upper part (12) on which a user's foot is intended to rest. The sole (11) includes a rear support element (14) and a rear end (15) of the upper part (12), and a front support element (16) of a front end (17) of the upper part (12). The front (16) and rear (14) support elements delimit an open space (20) with the upper part (12), extending substantially over the entire length of the upper part (12).

11 Claims, 3 Drawing Sheets

(56) References Cited

U.S. PATENT DOCUMENTS 2,755,567 A 7/1956 Rudine
2,759,284 A * 8/1956 Santisi ..... A43B 3/24 36/11.5
3,352,033 A * 11/1967 Colley ..... A43B 3/128 36/11.5
4,094,081 A 6/1978 Reiner et al.
4,314,412 A * 2/1982 Anderson ..... A43B 3/12 36/100
4,967,750 A * 11/1990 Cherniak ..... A43C 11/1493 36/11.5
6,499,234 B2 * 12/2002 Manzi ..... A43B 3/122 36/100
7,210,251 B1 * 5/2007 Rolle ..... A43B 1/0081 36/100
8,413,349 B2 * 4/2013 Krauss ..... A43B 7/26 36/11.5
8,544,196 B2 * 10/2013 Leo ..... A43B 23/24 24/3.1
8,667,712 B2 * 3/2014 Baum ..... A43B 1/0027 36/100
2002/0078600 A1 6/2002 Berg et al.
2002/0144430 A1 10/2002 Schmid
2003/0101625 A1 * 6/2003 Wu ..... A43B 1/0054 36/136
2004/0118016 A1 * 6/2004 Tonkel ..... A43B 3/102 36/11.5
2005/0039344 A1 * 2/2005 Berg ..... A43B 1/0027 36/11.5
2006/0026779 A1 * 2/2006 Berg ..... A43B 1/0027 12/142 S
2006/0080867 A1 * 4/2006 Chi ..... A43B 1/0027 36/136
2006/0150441 A1 7/2006 Cody et al.
2006/0156586 A1 * 7/2006 Brunelle-Wright .... A43B 3/122 36/89
2007/0051016 A1 * 3/2007 Zorin ..... A43B 3/24 36/11.5
2007/0193064 A1 8/2007 Xu
2007/0209235 A1 * 9/2007 Brunelle-Wright .... A43B 3/126 36/50.1
2008/0271343 A1 * 11/2008 Ordenes Haag ..... A43B 3/24 36/101
2011/0061262 A1 * 3/2011 Krauss ..... A43B 7/26 36/11.5
2012/0042544 A1 * 2/2012 Leo ..... A43B 23/24 36/136
2012/0174443 A1 * 7/2012 Leo ..... A43B 23/24 36/136
2013/0180136 A1 * 7/2013 Leo ..... A43B 23/24 36/136
2015/0033584 A1 * 2/2015 Ferguson ..... A43B 3/122 36/103

* cited by examiner

ADJUSTABLE SHOE

BACKGROUND OF THE INVENTION

1. Field of the Invention

The present invention relates to an adjustable shoe.

2. Description of Related Art

Already known in the state of the art are adjustable shoes in particular including removable elements. Such an adjustable shoe generally includes a sole and at least one element for retaining a user's foot on that sole, said retaining element also being called the "upper" of the shoe.

The retaining element, for example formed by straps, may be fastened to the sole using removable fastening means, for example including snaps.

The adjustability of such a shoe is limited, in particular due to the fact that the shape, size and position of the retaining element are limited by the predefined locations of the fastening means on the sole.

Furthermore, the fastening means are generally arranged on the side of the sole, with the result that they do not make it possible to adjust the position of the fastener based on the user's desire or the morphology of the users foot. Furthermore, when the fastening means include snaps arranged on the side of the sole, such snaps may detach in an untimely manner.

SUMMARY OF THE INVENTION

The invention in particular aims to resolve these drawbacks, by providing a shoe with improved adjustability and reliability.

To that end, the invention in particular relates to a shoe, of the type including a sole, in particular comprising an upper part on which a users foot is intended to rest, characterized in that:

- the sole includes a rear support element for a rear end of the upper part, and a front support element for a front end of the upper part, and
- the front and rear support elements delimit an open space with the upper part, extending substantially over the entire length of that upper part.

The upper part of the sole, also called "insole" or "inner sole", is the part of the sole on which the users foot rests. This upper part therefore generally has a shape substantially complementary to that of the sole of the foot.

According to the invention, the front and rear support elements form spacers between the upper part of the sole (where the foot rests) and the ground, thereby forming an open space under substantially the entire length of the upper part.

Such an open space allows greater adjustability of the shoe according to the invention.

In fact, this open space for example allows the passage of at least part of the retaining element below the upper part of the sole, and in any position assumed over the length of the upper part. In other words, this retaining element may be arranged at any location of the upper part, without the choice of its position being limited by a predefined location of the fastening means, such as buttons, snaps, hooks, etc.

The invention therefore allows considerable freedom in the fastening, in particular making it possible to improve the originality and aesthetics of the shoe. In particular, such freedom in the fastening allows the user to choose a retaining element based on her foot type, and also to vary the retaining element each time the shoe is worn and used, based on the user's tastes and desires. The same shoe according to the invention therefore allows a very large number of possibilities in the type or position of the retaining element.

Furthermore, the invention makes it possible to arrange fastening means for the retaining element below the upper part of the sole. Such fastening means are then securely fastened, discreetly and esthetically, below the upper part of the sole, and have few risks of detaching in an impromptu manner, unlike the fastening means traditionally arranged on the side of the sole.

A shoe according to the invention may further include one or more of the following features, considered alone or according to any technically possible combinations.

- The shoe includes at least one element for retaining the user's foot on the sole, the upper part of the sole has an upper surface, on which the user's foot is intended to rest, and a lower surface, opposite the upper surface, designed to face the ground, and the lower surface includes means for catching the retaining element.
- The catching means include at least one first strip of the Velcro type, for example with hooks, fastened on the lower surface of the upper part of the sole, and the retaining element includes at least one second strip of the Velcro type complementary to the first, for example with pile.
- The retaining element forms a ribbon, intended to be wound around the upper part and the user's foot.
- The upper part of the sole has a through orifice for the passage of the retaining element.
- The sole includes a lower part, delimiting the open space with the front and rear support elements and the upper part of the sole.
- The lower part of the sole having a lower face intended to cooperate with the ground and an upper face opposite the lower face, the lower face is provided with at least one damping strip, for example made from rubber.
- The lower part of the sole has a lower face intended to cooperate with the ground and an upper face opposite the lower face, the upper face is provided with fastening means for at least one decorative accessory.
- The fastening means include a metal plate, intended to maintain at least one decorative accessory fastened magnetically.
- The fastening means include at least one groove, formed in the upper face of the lower part or in the rear part intended to receive, by snapping or sliding, a complementary rib borne by a decorative accessory.

BRIEF DESCRIPTION OF THE DRAWING FIGURES

The invention will be better understood upon reading the following description, provided solely as an example and done in reference to the appended figures, in which.

DETAILED DESCRIPTION OF THE INVENTION

Figure 1:
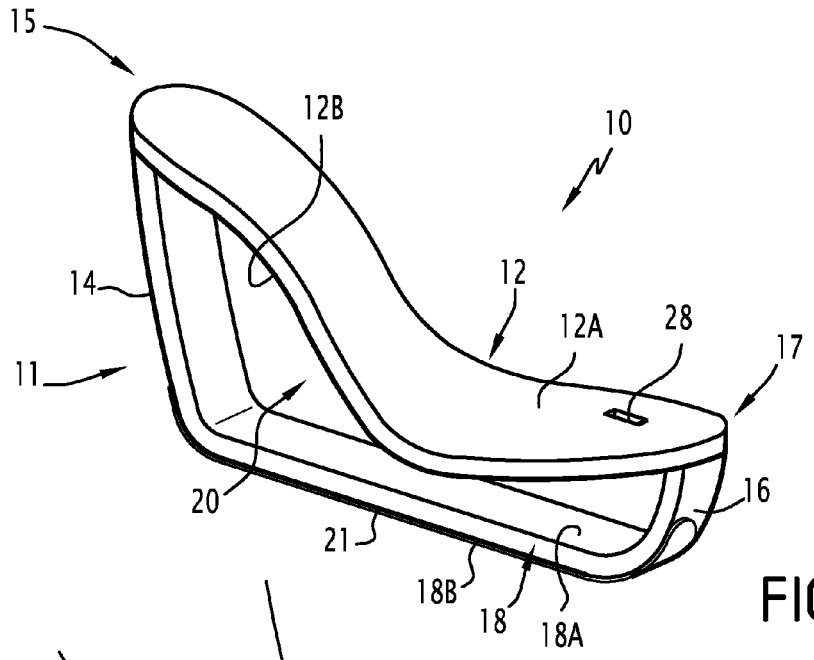
FIG. 1 is a perspective view of a shoe according to one example embodiment of the invention.

FIG. 1 shows a shoe 10 according to one example embodiment of the invention. The shoe 10 includes a sole 11, in particular including an upper part 12, also called "insole" or "inner sole", on which a users foot is intended to rest. This upper part 12 therefore generally has a shape substantially complementary to that of the sole of the foot.

The upper part 12 has an upper surface 12A designed to receive the user's foot, and a lower surface 12B opposite the upper surface 12A, designed to face the ground when the shoe 10 is in use.

Optionally, an insole may be added and fastened, removably or permanently, on all or part of the upper surface 12A, so as to provide increased comfort and ergonomics in accordance with the use and desire of the user.

The sole 11 furthermore includes a rear element 14 for supporting a rear end 15 of the upper part 12.

The sole 11 according to the invention also includes a front element 16 for supporting a front end 17 of the upper part 12.

These rear 14 and front 16 support elements delimit, with the upper part 12, an open space 20, while forming spacers between that upper part 12 and the ground. It will be noted that, since the rear 14 and front 16 support elements are arranged at the rear 15 and front 17 ends of the upper part 12, the open space 20 extends substantially below the entire length of the upper part 12. In other words, these rear 14 and front 16 support elements collaborate to raise the upper part 12 in its entirety.

According to the embodiment shown in FIG. 1, the sole 11 also includes a lower part 18, with a substantially planar shape. This lower part 18, also called "out sole" or "outer sole", is the part of the sole designed to come into contact with the ground during use of the shoe 10.

The front 16 and rear 14 support elements extend between said lower part 18 and the upper part 12, so as to form a spacer between them. Thus, the open space 20 is limited heightwise by the upper part 12 and the lower part 18, and is limited lengthwise by the rear 14 and front 16 support elements. However, the space 20 is open on the sides.

In the example shown in FIG. 1, the rear 14, front 16 support element, respectively, extends the lower part 18 without any change in level. In other words, the parts 14, 16 and 18 form a wedge heel that is very rounded on the front (base of the front element 16) and rear (base of the rear element 14) of the lower part 18, so as to allow optimal rolling of the foot during walking. Preferably, the lower part 18 includes a limited planar area, formed substantially in the middle of that lower part 18, allowing stability of the shoe and rest for the user when in the stopped position.

Alternatively, the rear support element 14, 16, respectively, may be separated from the lower part 18 by a change in level.

According to a first possible alternative embodiment, the sole 11 is made in a single piece. For example, the sole 11 may be made from a plastic material, in which case the upper part 12, the rear 14 and front 16 support elements, and the lower part 18 may be integral. The sole 11 may also be made from wood, or any other hollow, injected or molded material, these methods not being limiting.

According to a second possible alternative, the upper part 12, the rear 14 and front 16 support elements, and the lower part 18 may be attached to each other using traditional fastening means. The upper part 12, the rear 14 and front 16 support elements, and the lower part 18 are then made from identical or separate materials. It will be noted that these fastening means may be removable, so as to allow certain parts 12, 14, 16 and/or 18 to be replaced by others, so as for example to vary the types, shapes and/or colors of those parts.

It is also possible to provide non-removable fastening means, for example by gluing.

It will be noted that it is possible to provide all imaginable heights for the support elements 14, 16. In particular, the height of the rear support element 14 is chosen as a function of the desired heel height for the shoe 10. According to one alternative that is not shown, the rear 14 and front 16 support elements may have substantially identical heights, in which case the upper part 12 of the sole 11 is substantially parallel to the ground, and to the lower part 18 when the sole 11 includes such a lower part 18.

The lower part 18 has a lower face 18B intended to cooperate with the ground and an upper face 18A opposite the lower face 18B.

Preferably, the lower face 18B is provided with at least one damping strip 21, for example made from rubber, protecting the base 18 from wear and improving walking comfort.

The shoe 10 furthermore includes at least one element 22 for retaining the user's foot on the sole 11. Such a retaining element 22 is also called the upper of the shoe. Examples of retaining elements 22 are shown in FIGS. 2 and 3.

Figure 2:
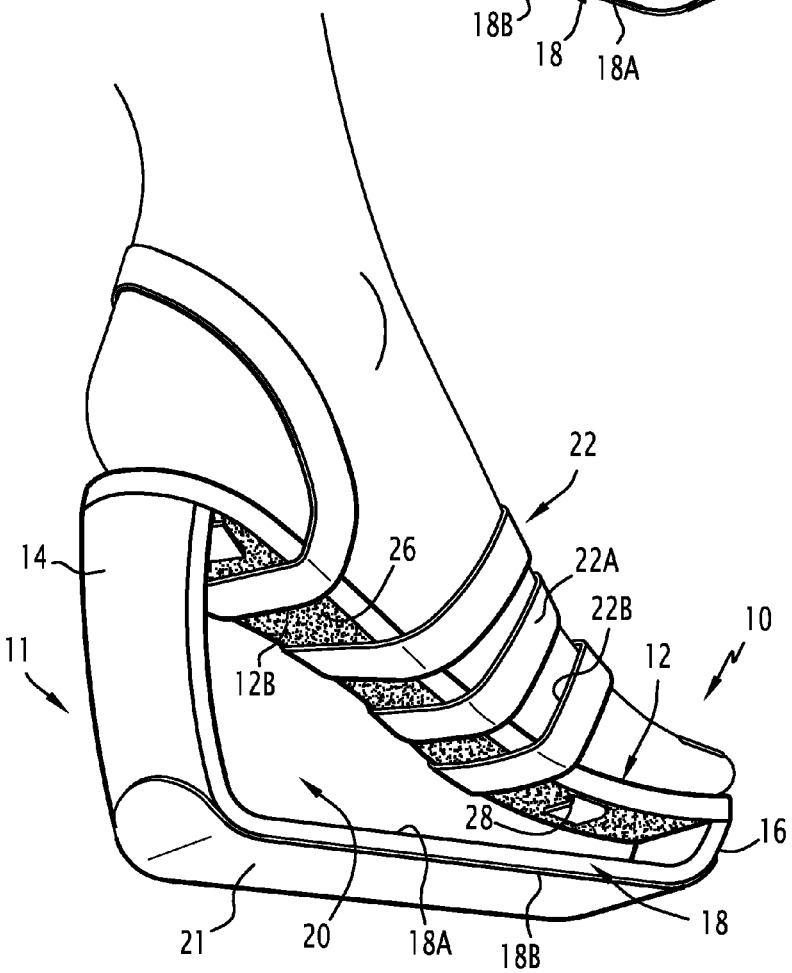
FIG. 2 is a perspective view of the shoe of FIG. 1, provided with an element for retaining one of the user's feet.
Figure 3:
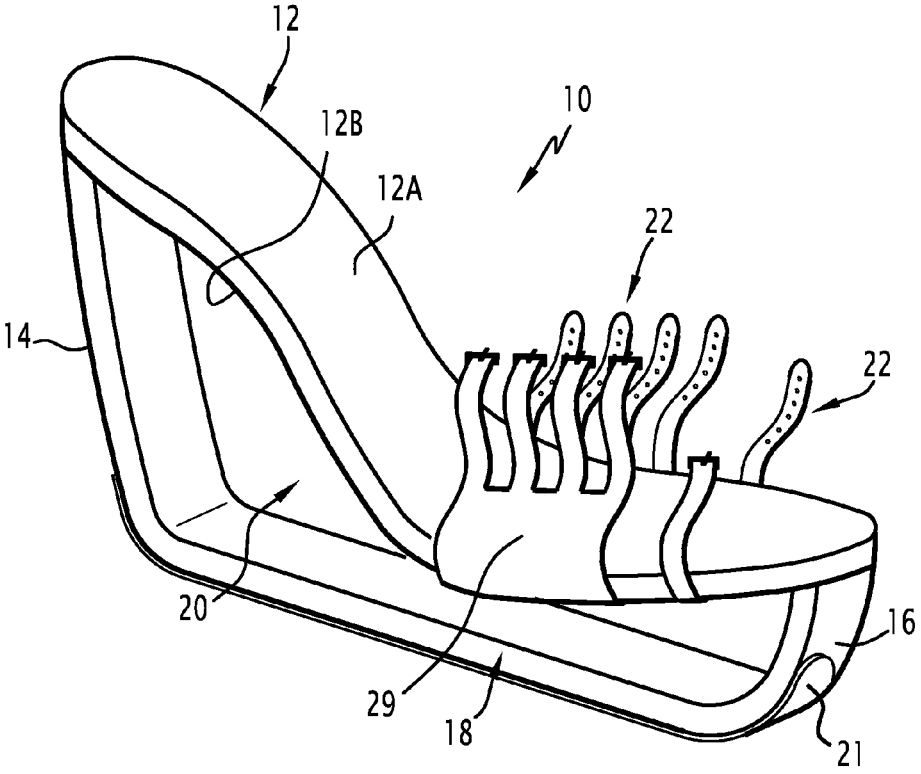
FIG. 3 is a view similar to FIG. 1 of the shoe of FIG. 1 equipped with a retaining element different from that of FIG. 2.

According to the example shown in FIG. 2, the retaining element 22 forms a narrow ribbon, or strap, winding both around the foot and the upper part 12 so as to surround them together.

This retaining element 22 being wound around the foot, it systematically adapts to the shape of the foot when it is assembled to the sole 11 in the presence of the foot. Furthermore, owing to the open space 20 extending below the entire width of the upper part 12, this retaining element 22 may pass at any location of the length of the sole 12 and the foot. In particular, the retaining element 22 may pass at the front of the foot, which would not be possible if the open space 20 did not extend under the front of the upper part 12.

It will be noted that the ribbon 22 may be wound in the desired manner by the user according to the configuration the user deems preferable for comfort and/or the desired appearance of the shoe.

Preferably, the lower surface 12B of the upper part 12 includes catching means 24 for the retaining element 22.

In the example shown in FIG. 2, the catching means 24 include at least one first Velcro-type strap 26, for example with hooks, fastened to the lower surface 12B of the upper part 12, for example extending over the entire length thereof. The retaining element 22 then includes at least one second Velcro-type strip complementary to the first, for example with pile, extending for example over the entire length of the retaining element 22.

The retaining element 22 therefore has a visible upper part 22A, and a non-visible back part 22B, comprising the fastening means, for example of the Velcro pile type. Depending on the shape of the retaining elements 22, these fastening means may cover all or only part of the back part.

Such catching means 24 with Velcro-type strips allow optimal adjustability, as the catching may be done at any location on the lower surface 12B for the retaining element 22. Thus, the retaining element 22 does not need to be in a specific location of the lower surface 12B to be attached thereto.

Furthermore, these catching means 24 with Velcro-type strips allow effective fastening of the retaining element 22 below the upper part 12 of the sole 11, in particular when the retaining element 22 is a ribbon winding around the foot and the sole 12, passing several times below the upper part 12 while being fastened upon each passage by the catching means of the Velcro type 24.

Thus, the retaining element 22 may be wound freely on the foot based on the design chosen for the user. Preferably, the Velcro pile-type strip covers all of the back part of the retaining element 22. Thus, this retaining element 22 may be arranged on the sole 11 in a large number of possible positions.

A retaining element 22 of the ribbon type may be offered to the user by the meter or the roll, so that the user may cut it to the desired length based on the esthetic and comfort the user wishes to give the shoe each time it is used. Such ribbons have visible parts made from quite varied materials, colors and designs.

The user may then start the fastening of the retaining element 22 in the form of a ribbon from her toes, then moving up toward the heel, for example surrounding her ankle one or more times to end with a knot at the ankle or fastening on the lower surface 22B.

It is of course understood that any other conceivable fastening means for the retaining element 22 may be provided.

It is for example possible to provide fastening spurs protruding toward the open space 20 from the lower surface 12B, and orifices complementary to those spurs formed in the retaining element 22.

The open space 20 also makes it possible to consider fastening means including snaps, the female (male, respectively) parts of which are arranged on the lower surface 12B and the male (female, respectively) parts of which are arranged on the retaining element 22. Due to their position below the upper part 12, such snaps have very little risk of detaching in an impromptu manner.

In the described embodiment, the upper part 12 includes a through orifice 28 allowing the passage of the ribbon 22, for example, as shown in FIG. 2. Such an orifice 28 is preferably provided between the big toe and index of the user's foot, so as to pass the ribbon there for comfort or appearance reasons, and in particular makes it possible to start the fastening of a retaining element 22. This orifice 28 also additionally makes it possible to arrange the retaining element 22.

It will be noted that the orifice 28 could also allow snapping of one end of the retaining element 22 in the form of a strip, or the passage of an attachment member of that strip 22.

It is possible to provide other forms of retaining element 22, in particular more sophisticated, complex and decorative forms than a simple ribbon. The retaining element 22 may for example be provided with decorative accessories, in particular in the case of models of the Tropezien® type.

It will be noted that several retaining elements 22, which may be similar or different, may be attached together on a same shoe. Such combinations of retaining elements allow a corresponding amount of additional variety and originality for the user.

The retaining elements 22 may also be provided with a second visible fastening means, which is then an integral and decorative part of that retaining element. Such a retaining element 22 can then offer two tightening possibilities, i.e., using the typical Velcro-type method fastened on the lower surface 12B, or adjusting the second fastening means. The second fastening means may include metal loops, buttons or snaps, eyes with laces, rings, elastic bands, hooks, etc.

FIG. 3 shows another example of a retaining element 22. In this example, the shoe 10 includes two retaining elements 22, one of which, seen at the front of the foot, forms a strap, and the other of which, provided on top of the foot, forms a set of straps connected by a central strip 29.

The strap and the set of straps each include a central strip of the Velcro type, allowing fastening thereof on the complementary Velcro-type strip of the lower surface 12B of the upper part 12. Each strap has a first side part provided with a loop and a second side part provided with orifices complementary to that loop to close the retaining element 22 including that strap around the users foot.

Alternatively, each retaining element 22 may include an upper part, intended to rest on the foot, already closed or continuous, extended by two side panels, each panel being provided with a Velcro-type strip, intended to be fastened on the complementary Velcro-type strip of the lower surface 12B of the upper part 12.

Of course, these examples of retaining elements 22 previously described are not limiting. In particular, the shoe 10 in particular has the advantage of allowing a multitude of different retaining elements 22 to be used. The shoe 10 described in reference to FIG. 3 could for example be supplemented by an additional retaining element for the users ankle.

Another advantage related to the open space 20 of the sole 11 is that it forms a much emptier hollow sole, which makes a large part of the inside of that sole 11 completely visible. That visible space 20 can therefore be used to improve the appearance of the shoe 10, in particular by decorating, trimming or covering the walls delimiting that space 20.

It is thus possible to arrange decorative accessories, such as images, text, words, small objects and/or figurines, in that space 20, as long as their size remains smaller than the dimensions of that space 20. These decorative accessories may be two- or three-dimensional.

These decorative accessories thus form a decoration, which may be permanent or removable.

Figure 4:
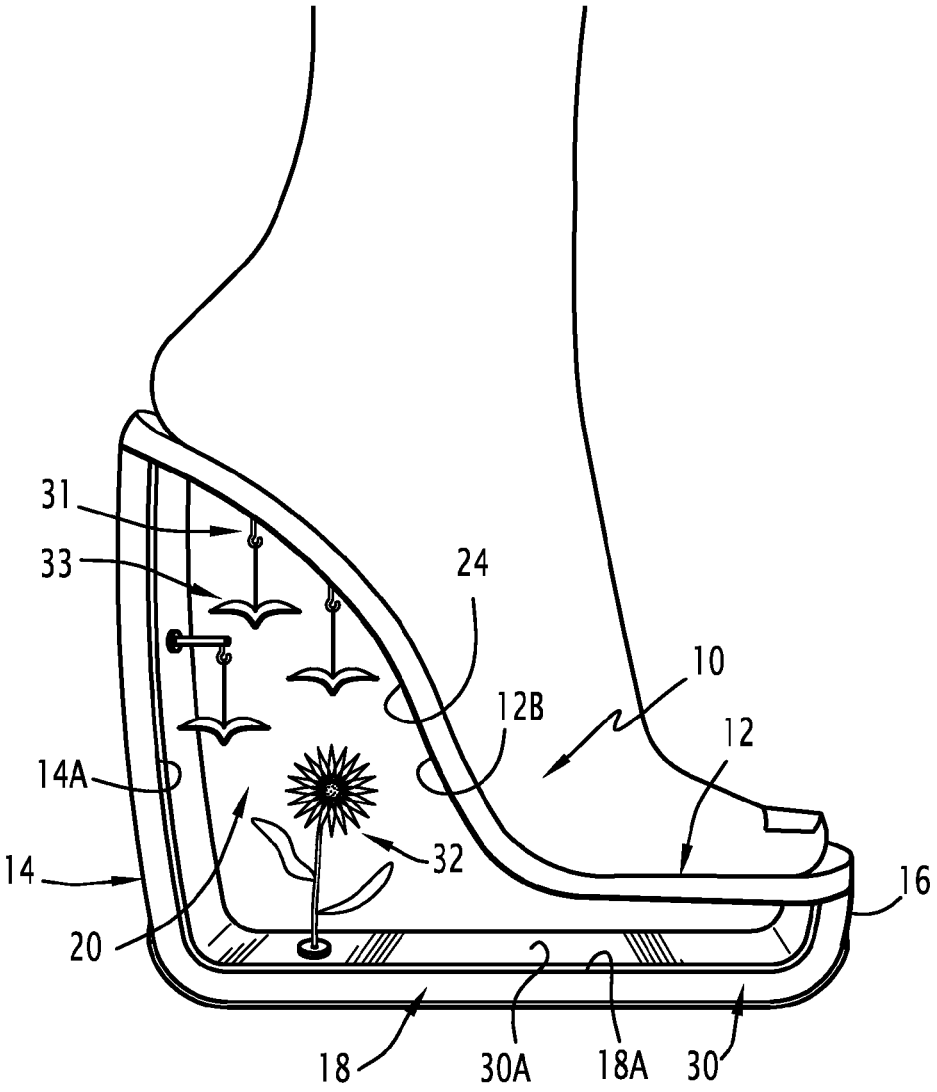
FIG. 4 is a profile view of the shoe of FIG. 1 provided with decorative accessories.

One example of a decoration arranged in the space 20 is shown in FIG. 4.

Means 30 for fastening decorative accessories 32 are provided on the lower part 18 of the sole 11, in particular in its upper face 18A. These fastening means 30 may be made in any possible way, the examples below only being provided for information and non-limitingly.

According to the described example embodiment, the upper face 18A of the lower part 18 and/or an inner face 14A of the rear support element 14, facing the open space 20, are provided with a metal plate 30A, which may or may not be painted, allowing maintenance of the decorative accessories 32 fastened magnetically in the space 20.

The decorative accessories may be of any possible type, for example to impart a decorative theme to the shoe 10. For example, the decorative accessories 32 may be formed by figurines, or may depict letters to form words. These accessories 32 may also represent various objects, such as a flower as shown in FIG. 4. An accessory may also be formed by a plate decorated by drawing, or adapted for writing words.

Alternatively, it is possible to provide other types of fastening means 30, for example pins protruding from the upper face 18A of the lower part 18, on which the decorative accessories 32 would be snapped. It is also possible to provide orifices formed in the upper face 18A, in which the accessories 32 would be snapped.

According to another alternative, the fastening means 30 include grooves, formed in the upper face 18A of the lower part 18, and extending laterally, longitudinally, or at an angle, on the upper face 18A. Such a groove is then intended to receive, by snapping or sliding, a complementary rib supported by a decorative accessory 32.

According to another alternative, decorative accessories 32, 33 could be fastened permanently in the free space 20, for example by gluing, in particular on the lower part 18. In the case where the lower part 18 is removably attached in the sole 11, replacing the lower part 18 would also make it possible to replace the decorative accessories fastened thereto.

As a replacement or jointly with the fastening means 30 provided on the lower part 18, it is possible to provide fastening means on the rear 14 or front 16 support part, or below the upper part 12.

Furthermore, accessory fastening means 31 below the upper part 12 would make it possible to suspend an accessory 33 below the upper part 12. Such a suspended accessory 33, for example depicting a bird as in FIG. 4, or a birdcage, a swing, or any other object, is generally movable when the shoe 10 moves.

These fastening means 31 may be of any imaginable type. For example, it is possible to provide hooks fastened on the lower surface 12B of the upper part 12, as shown in FIG. 4. It is also possible to provide suspension rings, to which hooks would be attached borne by the suspended accessories 33.

Alternatively, these fastening means 31 for accessories 33 may be formed by the fastening means 24 of the retaining element 22. For example, each suspended accessory 33 includes a Velcro pile-type strip, designed to be attached to the Velcro hook-type strip 26 of the lower surface 12B.

It will be noted that the invention is not limited to the embodiment previously described, but may include various alternatives without going beyond the scope of the claims.

For example, a shoe 10 could include a retaining element 22 permanently fastened on the sole 11, the adjustability of the shoe then consisting of the addition of the decorative accessories 32, 33, that adjustability being related to the free space 20 below the upper part 12.

The invention claimed is:

1. A shoe, comprising:

a sole comprising an upper part configured for a user's foot to rest, at least one element configured for retaining the user's foot on the sole, a rear support element of the sole for a rear end of the upper part, and a front support element for a front end of the upper part, and the front and rear support elements delimit an open space with the upper part, extending over the entire length of the shoe, the upper part of the sole has an upper surface, configured for the user's foot to rest, and a lower surface, opposite the upper surface, configured to face the ground, wherein the lower surface comprising fastening spurs for catching the retaining element, the fastening spurs protruding toward the open space from the lower surface, and orifices complementary to those spurs formed in the retaining element.

2. The shoe according to claim 1, wherein the fastening spurs include at least one first strip of hook and loop fasteners, with hooks, fastened on the lower surface of the upper part of the sole, and the retaining element includes at least one second strip of hook and loop fasteners complementary to the first, for example with pile.

3. The shoe according to claim 1, wherein the retaining element forms a ribbon, configured to be wound around the upper part and the user's foot.

4. The shoe according to claim 3, wherein the upper part of the sole has a through orifice for the passage of the retaining element.

5. The shoe according to claim 1, wherein the sole includes a lower part, delimiting the open space with the front and rear support elements and the upper part of the sole.

6. The shoe according to claim 5, wherein, the lower part of the sole having a lower face intended to cooperate with the ground and an upper face opposite the lower face, the lower face is provided with at least one damping strip.

7. The shoe according to claim 5, wherein, the lower part of the sole having a lower face intended to cooperate with the ground and an upper face opposite the lower face, the upper face is provided with a fastener for at least one decorative accessory.

8. The shoe according to claim 7, wherein the fastener includes a metal plate, intended to maintain at least one decorative accessory fastened magnetically.

9. The shoe according to claim 6, wherein the at least one damping strip is made from rubber.

10. A shoe, comprising:

a sole comprising an upper part configured for a user's foot to rest, at least one element configured for retaining the user's foot on the sole, a rear support element of the sole for a rear end of the upper part, and a front support element for a front end of the upper part, and the front and rear support elements delimit an open space with the upper part, extending over the entire length of the shoe, the upper part of the sole has an upper surface, configured for the user's foot to rest, and a lower surface, opposite the upper surface, configured to face the ground, wherein the lower surface comprising fastening spurs for catching the retaining element, the fastening spurs protruding toward the open space from the lower surface, and orifices complementary to those spurs formed in the retaining element, and wherein the sole includes a lower part, delimiting the open space with the front and rear support elements and the upper part of the sole.

11. A shoe, comprising:

a sole comprising an upper part configured for a user's foot to rest, at least one element configured for retaining the user's foot on the sole, a rear support element of the sole for a rear end of the upper part, and a front support element for a front end of the upper part, and the front and rear support elements delimit an open space with the upper part, extending substantially over the entire length of the shoe, the upper part of the sole has an upper surface, configured for the user's foot to rest, and a lower surface, opposite the upper surface, configured to face the ground, wherein the lower surface comprising fastening spurs for catching the retaining element, the fastening spurs protruding toward the open space from the lower surface, and orifices complementary to those spurs formed in the retaining element, and the lower part of the sole has a lower face intended to cooperate with the ground and an upper face opposite the lower face, the upper face is provided with a fastener for at least one decorative accessory.

* * * * *